United States Patent [19]

Goodell et al.

[11] Patent Number: 4,719,840

[45] Date of Patent: Jan. 19, 1988

[54] STIFF-BACKED RAMMING CHAIN

[75] Inventors: Bradley D. Goodell, Anoka; Ronald A. Larson, Minneapolis, both of Minn.

[73] Assignee: FMC Corporation, Chicago, Ill.

[21] Appl. No.: 742,244

[22] Filed: Jun. 7, 1985

[51] Int. Cl.[4] ..... F41F 9/06
[52] U.S. Cl. ..... 89/47
[58] Field of Search ..... 89/47

[56] References Cited

U.S. PATENT DOCUMENTS

| | | | |
|---|---|---|---|
| 804,243 | 11/1905 | Meigs et al. | 89/47 |
| 904,966 | 11/1908 | Knoch | 89/47 |
| 987,513 | 3/1911 | Vogeler | 89/47 |
| 3,670,624 | 6/1972 | Hayes et al. | 89/47 |
| 3,727,515 | 4/1973 | Nelson et al. | 89/47 |

FOREIGN PATENT DOCUMENTS

| | | | |
|---|---|---|---|
| 116232 | 10/1876 | France | 89/47 |
| 4614 | of 1896 | United Kingdom | 89/47 |
| 175777 | 2/1922 | United Kingdom | 89/47 |

*Primary Examiner*—Deborah L. Kyle
*Assistant Examiner*—Michael J. Carone
*Attorney, Agent, or Firm*—Ronald C. Kamp; Richard B. Megley

[57] ABSTRACT

A compact rammer assembly for forcing ammunition into a gun having a rammer head attached to a pair of chains which are stored in separate spiral tracks positioned between the retracted position of the rammer head and driven sprockets. Each chain composed of links pinned together with vertical tabs at each end of each link; the tabs on each link engaging the tabs on adjacent links of each chain as well as the corresponding tabs on the links of the other chain when the sprockets driven the chains to extend the rammer head.

4 Claims, 5 Drawing Figures

FIG_3
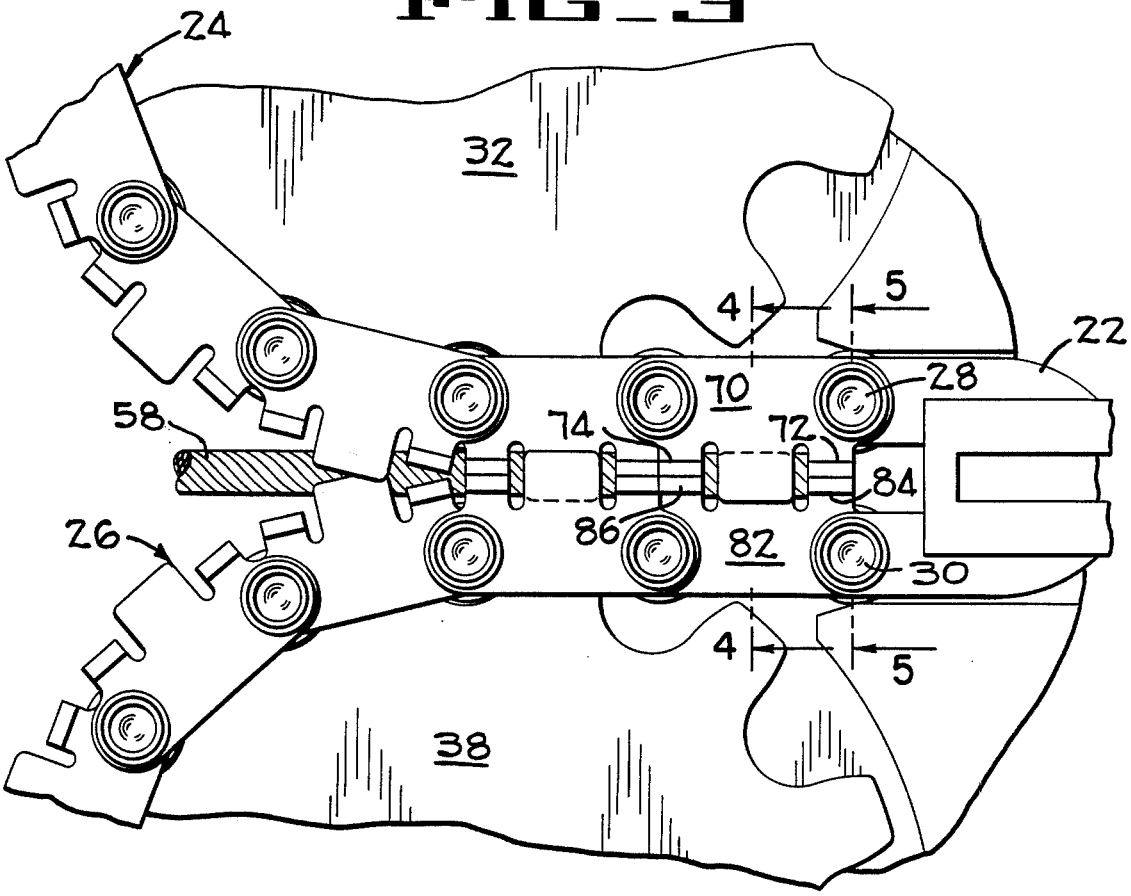
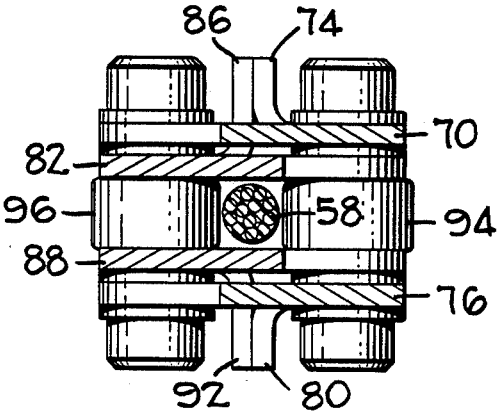
FIG_4
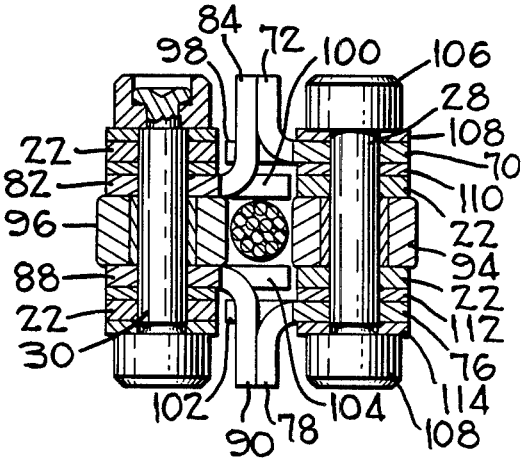
FIG_5

STIFF-BACKED RAMMING CHAIN

This invention relates to stiff-backed ramming chains i.e., chains for forcing ammunition into the breech of a gun, generally, and more particularly, to such chains which may be stored in a fraction of their extended length.

The present invention provides a ramming chain which is capable, when extended, of withstanding a substantial compressive load without buckling, which can be compactly stored when retracted, which is self-supporting and does not require additional guides or support structure when extended, which permits a mechanical or electrical cable to pass longitudinally of the chain when interlocked and extended, and which is relatively simple and inexpensive to manufacture and maintain.

These and other attributes, and many of the attendant advantages of the present invention will become more readily apparent upon a perusal of the following description and the accompanying drawings, wherein:

FIG. 3 is a detailed plan view of the drive sprocket arrangement showing the two chains forming the interlocked ramming chain;

FIG. 4 is a cross-sectional view taken on line 4—4 of FIG. 3; and

FIG. 5 is a cross-sectional view taken on line 5—5 of FIG. 3.

Figure 1:
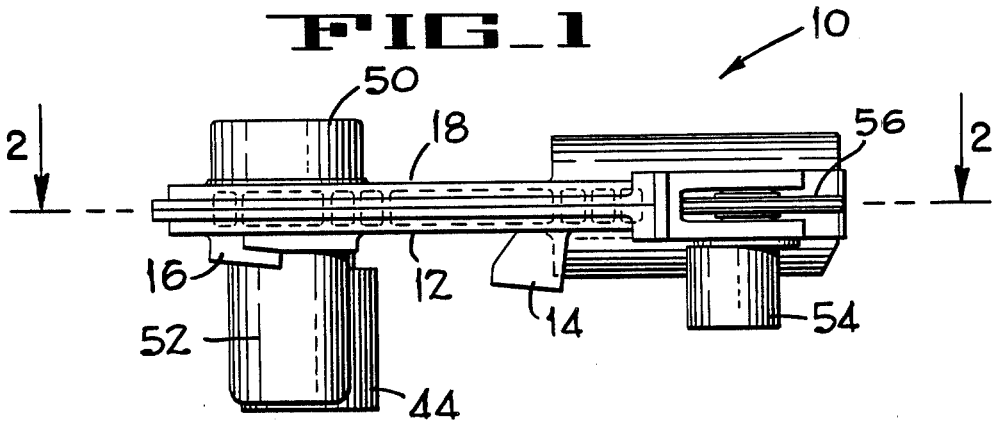
FIG. 1 is a side elevational view of a ramming chain device according to the present invention.
Figure 2:
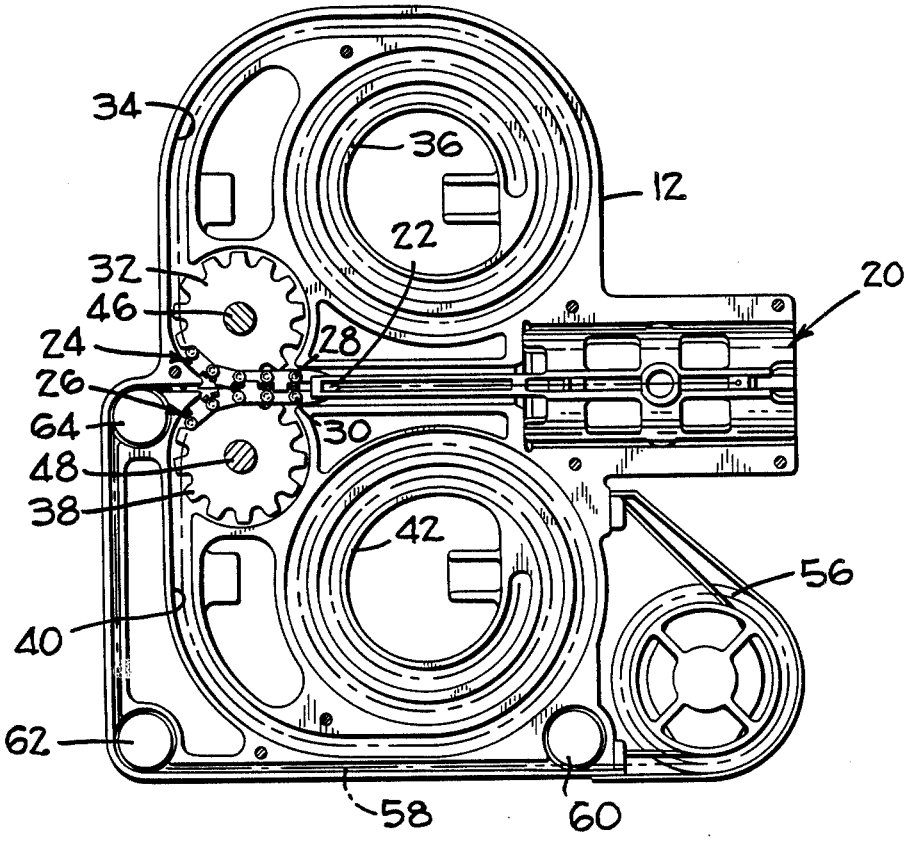
FIG. 2 is a cross-sectional view taken on line 2—2 of FIG. 1.

Referring now to FIG. 1, there is shown a rammer assembly, indicated generally at 10, including a frame 12 with mounting pads 14 and 16 for attachment to suitable supporting structure. A complementary cover 18 is detachably secured to the frame 12. A rammer head, indicated generally at 20, includes a rigid extension 22 to which a pair of stiff-backed chains 24 and 26 are pinned at 28 and 30 respectively. The chain 24 engages a drive sprocket 32 and is fed into and extracted from a track 34 formed in the frame 12 which leads from sprocket 32 and terminates in a spiral section 36 to compactly store the chain when the rammer head is retracted. The chain 26 engages drive sprocket 38 and is fed into and extracted from a similar track 40 terminating in spiral section 42. The spiral section 42 uncoils in a clockwise direction, while the spiral section 36 uncoils in a counter-clockwise direction. A hydraulic motor 44 is connected to drive the shaft 46 to which the sprocket 32 is affixed. The shaft 48 to which sprocket 38 is attached is driven by a pair of engaging gears, not shown, which are secured to each of the shafts 46 and 48 to assure that the two sprockets 32 and 38 are synchronized. A cover 50 encloses the aforementioned gear drive. An optical position encoder 52 is driven by the shaft 48 and controls a hydraulic motor 54 which is connected to a cable reel 56. A cable 58 is wound on the reel 56 and is trained over idler pulleys 60, 62 and 64, and attached to the rammer head 20. The optical encoder 52 controls fluid flow to the hydraulic motor 54 to insure that a constant tension is maintained on the cable 58 as the sprockets 32 and 38 extend and retract the rammer head.

The details of the two stiff-backed chains 24 and 26 and how they engage to form the ramming chain are shown in FIGS. 3-5. The links of each chain have upper and lower members; the upper links each having a pair of upward extending tabs and the lower links each having a pair of downward extending tabs. The sprockets 32 and 38 are spaced an appropriate distance apart so that the tabs on adjacent link members tightly engage each other as the sprockets are driven to extend the rammer head. Since all of the links are similar, a detailed description will be provided for only those links adjacent the extension 22.

The chain 24 is pinned to the extension 22 by pin 28 and the chain 26 is also pinned to the extension 22 by pin 30. Since the pins 28 and 30 are attached to the same rigid body, the distance between them cannot change. The upper link member 70 on the chain 24 is pivoted on the pin 28 and has a pair of upturned tabs 72 and 24, and the lower link member 76 has a pair of down turned tabs 78 and 80. Similarly, the upper link member 82 is pivoted on the pin 30 and has a pair of upturned tabs 84 and 86, while the lower link member 88 has a pair of downturned members 90 and 92. The upturned tabs 72 and 74 are in tight contact with the upturned tabs 84 and 86 and the downturned tabs 78 and 80 are in tight contact with the tabs 90 and 92. Any tendency for either the members 70 and 76 or the members 82 and 88 to pivot on their respective pins 28 and 30 will be resisted by the contact between the engaging tabs. Each pin 28 and 30 has a roller, 94 and 96 respectively, rotatable thereon for engagement with the associated sprocket 32 and 38.

Each link member has an extension in the plane of the member, such as shown at 98, 100 on upper links 70 and 82, respectively and at 102 and 104 on lower links 76 and 88 respectively. These extensions, along with the separation between the rollers, define a central space to accomodate the cable 58 longitudinally of the ramming chain. The lower extensions 104 and 102 are especially useful in maintaining the cable within the defined central space by supporting the cable 58, which would otherwise assume a catenary shape as the rammer head is extended.

The pins are provided with enlarged heads, such as shown at 106 and 108 on pin 28, at each end to hold the elements pivoted thereon in relatively tight contact and resist sagging of the chain in a vertical direction. Bearing washers, such as shown at 108, 110, 112 and 114 on pin 28, may be provided to permit relative rotation when required but to otherwise maintain tight engagement therebetween.

It should be noted that the link components may be economically made from simple stamped and bent components and are symmetrical to the extent that upper and lower links are physically the same but oriented differently by 180 degrees.

While one embodiment of the present invention has been illustrated and described herein, various changes and modifications may be made therein without departing from the spirit of the invention as defined by the scope of the appended claims.

What is claimed is:

1. In a rammer assembly having a frame with a rammer head extendable from a retracted position in said frame and a pair of driven sprockets rotatably mounted on said frame, an improved rammer chain assembly comprising:

a pair of chains attached to said rammer head with each of said pair of chains engaging one of said pair of sprockets;

each of said chains having a plurality of links pinned together at the forward and rearward ends thereof;

each of the links having a vertical tab at both the forward and rearward ends thereof; each of said tabs contacting the tab on the adjacent link of the same chain and contacting the corresponding tab on the link of the other chain to render the chain assembly rigid when the sprockets drive the chain together to extend the rammer head.

2. The invention according to claim 1, and further comprising:

a horizontal portion on each link to provide a support surface.

3. A compact rammer assembly comprising:

a frame;

a rammer head extendable from a retracted position in said frame;

a pair of chains attached to said rammer head;

a pair of driven sprockets rotatably mounted on said frame and engaging said chains;

a pair of tracks in said frame for separately receiving said chains;

each track terminating in a spiral section positioned between said rammer head retracted position and the associated sprocket; and each chain of said pair of chains having a plurality of links pinned together with each link including a vertical tab at each end thereof which tabs are positioned on the side of the link toward the other chain and each tab contacting the tab on the adjacent link and contacting the corresponding tab on links of the other chain when the sprockets drive the chains together to extend the rammer head.

4. The invention according to claim 3 wherein each of said links includes a horizontal portion positioned between said tabs and extending toward the other chain to define an unobstructure tunnel when said rammer head is extended.

* * * * *